US005245692A

United States Patent [19]

Kawai

[11] Patent Number: 5,245,692

[45] Date of Patent: Sep. 14, 1993

[54] PORTABLE HEMISPHERIC ELECTRIC SPACE HEATER WITH CIRCUMFERENTIAL FILTERED WARM AIR DISCHARGE

[75] Inventor: Yuzou Kawai, Nara, Japan

[73] Assignee: Suiden Co., Ltd., Osaka, Japan

[21] Appl. No.: 621,827

[22] Filed: Dec. 4, 1990

[30] Foreign Application Priority Data

Sep. 14, 1989 [JP] Japan ..... 1-107715[U]

[51] Int. Cl.[5] ..... F24H 3/04; F24H 9/02; H05B 3/00

[52] U.S. Cl. ..... 392/367; 55/467; 165/125; 165/126; 392/363; 392/364; 392/368

[58] Field of Search ..... 392/360–369; 55/467; 165/122, 125, 126

[56] References Cited

U.S. PATENT DOCUMENTS

| | | | |
|---|---|---|---|
| 1,798,290 | 3/1931 | Winner et al. | 392/367 |
| 2,151,140 | 3/1939 | Novak | 392/365 X |
| 2,415,621 | 2/1947 | Arnhym | 55/467 X |
| 2,486,309 | 10/1949 | McIntosh | 392/373 |
| 3,223,828 | 12/1965 | Mast | 392/364 |
| 3,309,846 | 3/1967 | Schneider | 392/367 X |
| 4,034,204 | 7/1977 | Windsor et al. | 392/367 |
| 4,146,776 | 3/1979 | Johansen | 392/364 X |
| 4,882,467 | 11/1989 | Dimick | 392/379 X |

FOREIGN PATENT DOCUMENTS

| | | | |
|---|---|---|---|
| 993168 | 10/1951 | France | 392/367 |
| 869579 | 5/1961 | United Kingdom | 392/367 |
| 1321233 | 6/1973 | United Kingdom | 392/365 |

*Primary Examiner*—Anthony Bartis
*Attorney, Agent, or Firm*—Thomas R. Morrison

[57] ABSTRACT

An electric space heater includes a hemispherical enclosure in which is positioned a blower arranged to draw air in through air inlets proximate the pole of the hemisphere for discharge through a plurality of air discharge outlets around the circumference of the enclosure. A filter between the inlets and blower filters the air and electric heating elements are provided for heating the air prior to discharge through the circumferential outlets. The enclosure is fastened to a base lying entirely within the periphery of the enclosure and supporting the blower and heating elements by a single fastener at the pole of the hemipshere with the filter captured between the enclosure and the internal parts of the heater supported on the base. The heater can be affixed to a surface by a mount attachable to the surface and having a threaded fastener engageable with a cooperating threaded member secured in a recess in the bottom of the base. The enclosure may be provided with wheels at its lower perimeter.

7 Claims, 2 Drawing Sheets

PORTABLE HEMISPHERIC ELECTRIC SPACE HEATER WITH CIRCUMFERENTIAL FILTERED WARM AIR DISCHARGE

BACKGROUND OF THE INVENTION

The present invention relates to space heaters, and more particularly to electric space heaters that use electrically heated elements to warm air directly in small living spaces.

The use of such electric space heaters is well known. Conventional space heaters are not fully enclosed because their heating elements must be exposed to a free flow of air. The heating elements are generally protected by open grills or screens. These heaters require placement on a level surface, usually a floor of a room. Because of their open construction, conventional heaters do not blend into a room decor and they are not mountable directly to a wall or ceiling surface. The open construction of conventional space heaters also prevents the use of filters to clean room air as they operate.

OBJECTS AND SUMMARY OF THE INVENTION

Accordingly, it is an object of the present invention to overcome the drawbacks of the prior art.

It is a further object of the invention to provide a space heater that is safer to operate and that is securely mountable to a variety of room surfaces for both safety and appearance.

It is a still further object of the invention to provide a space heater which can be assembled with a single fastener without requiring rotational alignment between parts.

It is a still further object of the invention to provide a space heater having a smooth aerodynamic flow of air between its blower and its heater element.

Briefly stated, there is provided an enclosed electric space heater that is mountable on a variety of room and furniture surfaces to blend into a room decor. Inlet and outlet holes in the enclosure communicate air to and from the space heater through an internal filter, a blower and a plurality of ceramic heating elements. The air output from the space heater is both filtered and heated.

Briefly stated, the present invention provides an enclosed electric space heater that is mountable on a variety of room and furniture surfaces to blend into a room decor. Inlet and outlet holes in the enclosure communicate air to and from the space heater through an internal filter, a blower and a plurality of ceramic heating elements. The air output from the space heater is both filtered and heated. An enclosure of the heater is hemispheric thus permitting assembly thereof without requiring rotational alignment. A single fastener, at a pole of the portion of a sphere fastens the enclosure to the base. The filter is captured between the inside of the enclosure and internal parts of the space heater. A plurality of wheels at a lower perimeter of the enclosure, roll upon a surface on which the heater is disposed. A separate mount is mountable on a surface onto which it is desired to affix the heater. Threaded engaging members on the mount and the heater engage each other to affix the heater to the surface.

The above and other objects, features and advantages of the invention will become apparent from the following description of the preferred embodiment read in conjunction with the accompanying drawings, in which like reference numerals designate the same elements.

DETAILED DESCRIPTION OF THE PREFERRED EMBODIMENT

Figure 1:
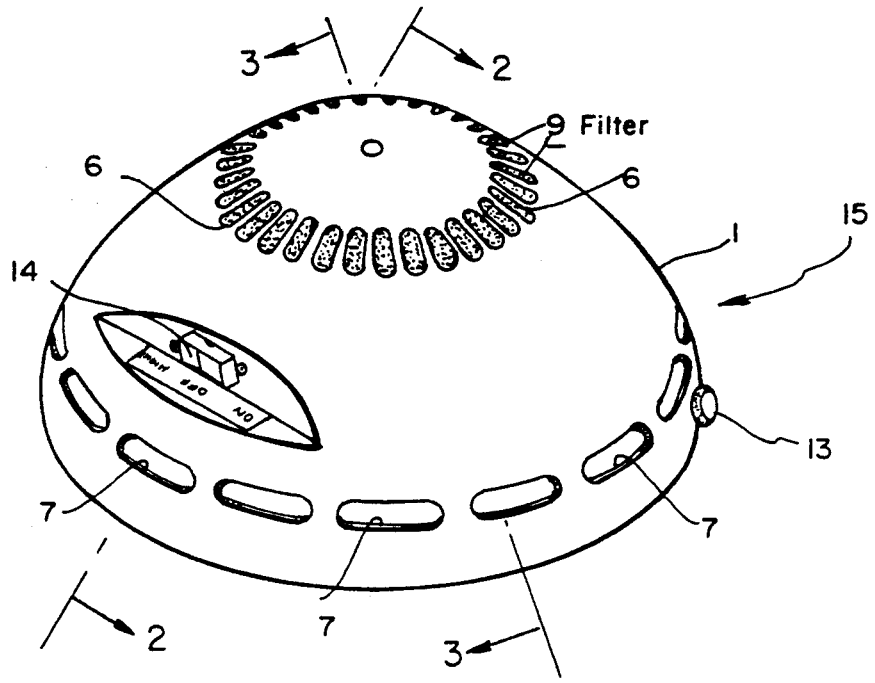
FIG. 1 is a perspective view of an electric heater according to a preferred embodiment of the invention.

Referring to FIG. 1, a space heater 15 has a generally hemispherical enclosure 1. A plurality of oval cool air inlet holes 6 are arranged radially proximate the pole of the hemispherical enclosure to form a ring around an axis of enclosure 1. A plurality of oval hot air outlet holes 7 are annularly arranged around enclosure 1 near its circumference. A control switch 14 is positioned in a wedge shaped recess 14*a* in enclosure 1 to avoid any protrusions in enclosure 1 and to minimize the possibility of inadvertent operation of switch 14. A single cover screw 1*b* located at the pole or axis of enclosure 1 secures enclosure 1 to space heater 15.

Figure 2:
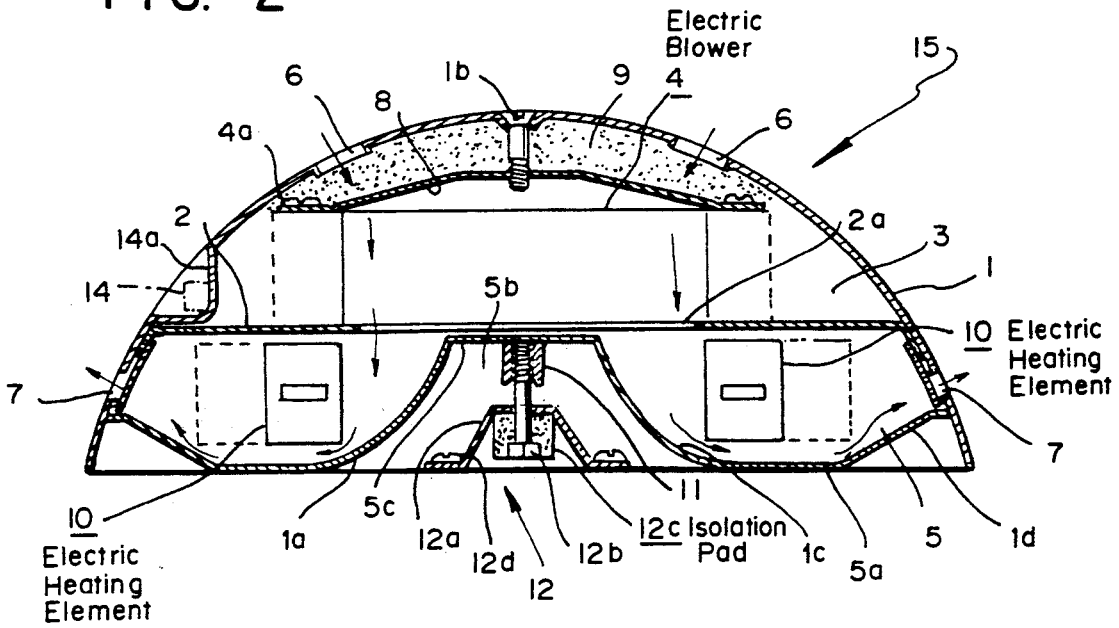
FIG. 2 is a cross section of the embodiment of FIG. 1.

Referring now to FIG. 2, a partition 2 having a large central, circular opening 2*a* divides the area within enclosure 1 into two chambers; an upper chamber 3 and a lower chamber 5. As seen in the figure, an electrically powered blower 4, which may be, for example, a ducted or squirrel cage fan, is mounted on partition 2 in upper chamber 3 to produce a downward flow of air directed through opening 2*a*. A plurality of screws 4*a*, that secure blower 4 to partition 2, also secure a perforated filter plate 8 to the top of blower 4. An air filter 9 is sandwiched between filter plate 8 and enclosure 1. Cover screw 1*b* secures enclosure 1 to filter plate 8. Enclosure 1 requires no special alignment during installation because of its circular perimeter and its single axial attachment, cover screw 1*b*.

Filter 9 may be removed for cleaning or replacement by loosening cover screw 1*b* removed. This allows enclosure 1 to be lifted away, thereby providing access to filter 9.

Figure 3:
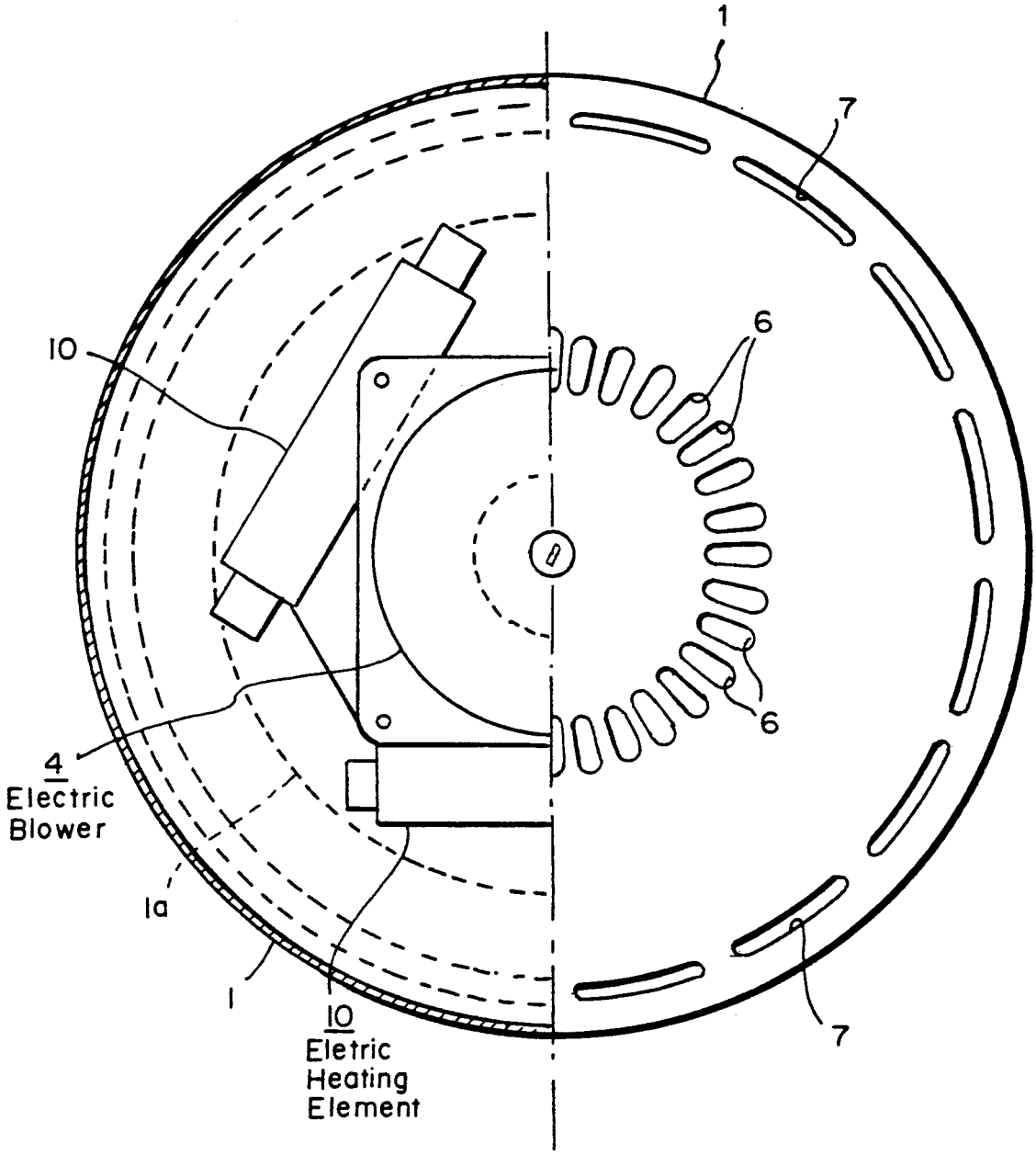
FIG. 3 is a top view of the embodiment of FIG. 1 with the left side of its enclosure removed.

Referring to FIGS. 2 and 3, an area below partition 2 is closed by a circular base 1*a* having an annular lower trough 5*a* defining the bottom limit of lower chamber 5. A plurality of electric heating elements 10 are disposed within lower chamber 5 about the perimeter of opening 2*a*. Heating elements 10 may be of any convenient type such as, for example, tungsten wire wound on a form or tungsten coils or the like in an insulating ceramic casing. Heating elements 10 are controlled by switch 14.

As can be seen in the figure, an inner wall 1*c* of trough 5*a* is parabolically curved to guide the air stream from blower 4 on a path from its initial downward direction into a radial direction for passing smoothly over heating elements 10. After passing over heating elements 10, heated air is guided between outer wall 1*d* of trough 5*a* and a lower surface of partition 2 to exit through outlet holes 7.

Outlet holes 7 are arranged in a radial array a short distance above the perimeter of enclosure 1 to disperse heated air radially and at an upward direction away from any surface upon which space heater 15 may be mounted or resting.

An axial recess 5b in base 1a approximates a conical trapezoid. A threaded cylinder 11 is suspended from a flattened axial area 5c of base 1a.

An optional mount 12 includes a bolt 12b captivated in an isolation pad 12c. A base 12a of mount 12 contains a plurality of holes for accommodating screws 12d for attaching mount 12 to a user desired surface. Isolation pad 12c isolates fan vibration from the mounting surface.

To mount space heater 15 on a surface, such as a room wall or ceiling, base 12a is affixed to the surface using screws 12d. Then, axial recess 5b is fitted over base 12a with bolt 12b aligned with threaded cylinder 11. Space heater 15 is rotated to engage bolt 12b in threaded cylinder 11, thereby affixing space heater on the surface.

The surface on which space heater 15 is mounted may be horizontal, such as a floor, vertical, such as a wall, or oblique. Space heater 15 may also be mounted upside down on a ceiling, or out of sight, on an under surface of a table top. When mounted on a wall, it can be placed high enough on the wall to remain out of the reach of children or to suit the decor of the room. The mounting capability of decorative enclosure 1 fully encloses space heater 15 to blend into the rooms decor.

A plurality of wheels 13 around the perimeter of enclosure 1 facilitate moving space heater 15. Wheels 13 may also be an aid in threading space heater 15 onto or off bolt 12b and to further isolate fan vibration from the mounting surface. Because area 5c is recessed, the outer perimeter of enclosure 1 is flush with the surface on which space heater 15 is mounted, thus concealing the mounting hardware.

During operation, switch 14 is set to either its LOW or HIGH on positions to turn on space heater 15 and to select either high or low hot air output. This causes blower 4 to draw room air into space heater 15 through inlet holes 6 and filter 9. The room air is filtered by filter 9 and blown by blower 4 through opening 2a to lower chamber 5. The filtered air is guided to heating elements 10 by inner wall 1c and heated as it passes over heating elements 10. Heated air is continued toward outlet holes 7 by outer wall 1d to exit space heater 15 into the surrounding space.

Having described the preferred embodiments of the invention with reference to the accompanying drawings, it is to be understood that the invention is not limited to those precise embodiments, and that various changes and modifications may be affected therein by one skilled in the art without departing from the scope or spirit of the invention as defined in the appended claims.

What is claimed is:

1. An electric space heater comprising:

a blower having an inlet side and an outlet side;

said blower blowing air in an axial direction from said inlet side to said outlet side;

a base;

said blower being spaced above said base and arranged to blow air axially downwardly toward said base;

means associated with said base for turning said air from said axial direction to an air path in a generally radial direction;

at least one electrical heating element in said air path;

said at least one electrical heating element, when energized, being effective for heating said air in said air path;

an enclosure covering said blower, said at least one heating element, and said base;

said enclosure being generally hemispheric;

air inlet means located proximate the pole of said enclosure;

said base lying entirely within the hemisphere of said enclosure whereby said space heater may rest flush on a planar surface;

at least one outlet hole located at the circumference of said enclosure; and said means for turning including means for passing heated air through said at least one outlet hole at an angle inclined upward from said radial direction, whereby said heated air is directed away from a surface upon which said electric heater is disposed.

2. An electric heater according to claim 1, further comprising:

means for affixing said enclosure to said base; and said means for affixing including a single fastener at the pole of said enclosure.

3. An electric heater according to claim 2, further comprising:

a filter;

said filter being disposed inside said enclosure adjacent said inlet means;

a filter plate inside said enclosure for filtering the air flowing into said enclosure; and said single fastener compressing said filter between said enclosure and said filter plate, whereby said filter is retained in place.

4. An electric space heater comprising:

a base;

said base being generally circular;

a partition affixed above said base, in spaced relation thereto;

an opening centered in said partition;

a blower affixed centered over said opening;

said blower, when energized, directing a stream of air axially through said opening;

at least one electrical heating element disposed in the path of said air stream;

said at least one electrical heating element, when energized, being effective for heating said air in said stream of air;

an enclosure covering said blower, said at least one heating element, and said base;

said enclosure being generally hemispheric;

air inlet means located proximate the pole of said enclosure;

at least one outlet hole located at the circumference of said enclosure;

said base being aerodynamically shaped and lying entirely within the hemisphere of said enclosure;

said aerodynamic shape being effective for turning said stream of air from an axial direction to a generally radial direction;

said at least one electrical heating element when energized, heating said stream of air; and said aerodynamic shape being further effective for discharging said stream of air outwardly from said enclosure, downstream of said at least one electrical heating element, at an angle inclined upward from a radial direction.

5. An electric space heater comprising:

a base;

an enclosure;

said enclosure being generally hemispherical;

a blower, in said enclosure between said base and said enclosure effective, when engaged, for producing a stream of air;

an electrical heating element in said enclosure in said stream of air effective, when energized, for heating said stream of air;

said base lying entirely within the hemisphere of said enclosure;

a recess in said base;

said recess being concave inward;

a first portion of a fastener, affixed to said base, in said recess;

a mount;

means for permitting affixing of said mount to a surface;

a second portion of said fastener affixed to said mount;

said first and second portions having engaging means engageable with each other when said recess is fitted over said mount; and said engaging means of said first and second portion engaging each other, whereby said electrical space heater may be affixed to said surface.

6. Apparatus according to claim 5, wherein:

said first portion is one of a bolt and a nut;

said second portion is the other of a bolt and a nut;

said engaging means being mating threads in said first and second portions;

said mating threads being engaged by rotating said base and said enclosure, relative to said surface, whereby said heater is affixed to said surface.

7. An electric heater comprising:

a blower;

an electrical heating element;

a base;

said blower being disposed above said base;

an enclosure covering said blower, said heating element, and said base;

said enclosure being generally hemispherical;

said base lying entirely within the hemisphere of said enclosure;

at least one inlet hole in a vicinity of a pole of said enclosure; and a plurality of wheels at a lower perimeter of said enclosure, said plurality of wheels being positioned to roll upon a surface facing a bottom of said base.

* * * * *